US009435213B2

(12) United States Patent
Wunderle et al.

(10) Patent No.: US 9,435,213 B2
(45) Date of Patent: Sep. 6, 2016

(54) METHOD FOR IMPROVING THE SEALING ON ROTOR ARRANGEMENTS

(75) Inventors: Helmar Wunderle, Waldshut-Tiengen (DE); Stefan Schlechtriem, Mellingen (CH); Peter Graf, Kussaberg (DE); Silvio Glaser, Birr (CH); Beat Von Arx, Trimbach (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 12/701,852

(22) Filed: Feb. 8, 2010

(65) Prior Publication Data

US 2010/0166563 A1 Jul. 1, 2010

Related U.S. Application Data

(63) Continuation of application No. PCT/EP2008/059507, filed on Jul. 21, 2008.

(30) Foreign Application Priority Data

Aug. 8, 2007 (CH) ..... 1258/07

(51) Int. Cl.
*F01D 5/30* (2006.01)
*F01D 11/00* (2006.01)

(52) U.S. Cl.
CPC ..... *F01D 5/3007* (2013.01); *F01D 11/005* (2013.01); *F05D 2240/55* (2013.01); *F05D 2250/13* (2013.01); *F05D 2250/182* (2013.01); *Y10T 29/49316* (2015.01)

(58) Field of Classification Search
CPC ..... F05D 2260/30
USPC ..... 416/220 R, 248, 219 R; 415/219 R, 415/220 R; 29/889
See application file for complete search history.

(56) References Cited

U.S. PATENT DOCUMENTS 3,047,268 A 7/1962 Leavitt
3,112,914 A 12/1963 Wellman
3,572,970 A * 3/1971 Smuland ..... F01D 5/323 416/190

(Continued)

FOREIGN PATENT DOCUMENTS

EP 0710766 A1 5/1996
EP 1795706 A1 6/2007

(Continued)

*Primary Examiner* — Sean J Younger
(74) *Attorney, Agent, or Firm* — Buchanan Ingersoll & Rooney PC

(57) ABSTRACT

A method is described for improving the sealing between rotor and a plurality of blades. The rotor has a plurality of generally axially extending profiled recesses into which a ring of blades, which have corresponding blade root profiles, are inserted in a form-fitting and/or frictionally locking manner into these recesses in a generally axial insertion direction. Between the recesses the rotor has tangential surface sections or circumferential surface sections which extend in the axial direction and circumferential direction and are generally indirectly covered by lower shrouds of circumferentially adjacently arranged blades in the radial direction. At least one of the tangential surface or circumferential surface sections is provided with a step in the radial direction, and a corresponding recess, which adjoins as flush as possible, is provided in the underside of the shroud of the blade which is arranged above it. Corresponding rotors or blades are also described.

10 Claims, 3 Drawing Sheets

(56) References Cited

U.S. PATENT DOCUMENTS

| | | | | | |
|---|---|---|---|---|---|
| 3,734,646 | A | * | 5/1973 | Perkins | F01D 5/326 416/193 A |
| 3,853,425 | A | * | 12/1974 | Scalzo et al. | 416/95 |
| 4,483,661 | A | * | 11/1984 | Manharth | F01D 5/326 416/220 R |
| 4,730,983 | A | * | 3/1988 | Naudet et al. | 416/220 R |
| 4,904,160 | A | * | 2/1990 | Partington | 416/193 A |
| 4,940,389 | A | | 7/1990 | Luxenburger | |
| 5,067,877 | A | | 11/1991 | Youssef | |
| 5,211,407 | A | * | 5/1993 | Glynn et al. | 277/632 |
| 5,257,909 | A | * | 11/1993 | Glynn et al. | 416/220 R |
| 5,281,097 | A | * | 1/1994 | Wilson et al. | 416/193 A |
| 5,302,086 | A | | 4/1994 | Kulesa et al. | |
| 5,445,499 | A | * | 8/1995 | Charbonnel | 416/220 R |
| 5,501,575 | A | * | 3/1996 | Eldredge et al. | 416/144 |
| 5,573,375 | A | | 11/1996 | Barcza | |
| 5,601,404 | A | * | 2/1997 | Collins | 415/173.7 |
| 5,662,458 | A | * | 9/1997 | Owen | 416/145 |
| 6,030,178 | A | | 2/2000 | Caruso | |
| 6,077,035 | A | * | 6/2000 | Walters et al. | 415/115 |
| 6,109,877 | A | * | 8/2000 | Gekht et al. | 416/221 |
| 6,190,131 | B1 | * | 2/2001 | Deallenbach | 416/144 |
| 6,634,863 | B1 | * | 10/2003 | Forrester et al. | 416/220 R |
| 6,786,696 | B2 | * | 9/2004 | Herman et al. | 416/96 R |
| 2004/0165989 | A1 | | 8/2004 | Caruso et al. | |
| 2004/0184919 | A1 | * | 9/2004 | Zabawa | 416/220 R |
| 2005/0196278 | A1 | * | 9/2005 | Boswell | 416/97 R |
| 2005/0201857 | A1 | * | 9/2005 | Ferra et al. | 415/115 |

FOREIGN PATENT DOCUMENTS

| | | | |
|---|---|---|---|
| GB | 1527074 | A | 10/1978 |
| JP | 1193005 | A | 8/1989 |
| JP | 8232602 | A | 9/1996 |
| JP | 2002510009 | A | 4/2002 |
| WO | 9950534 | A | 10/1999 |
| WO | 03027445 | A1 | 4/2003 |

* cited by examiner

METHOD FOR IMPROVING THE SEALING ON ROTOR ARRANGEMENTS

CROSS REFERENCE TO RELATED APPLICATION

This application is a continuation of International Application No. PCT/EP2008/059507 filed Jul. 21, 2008, which claims priority to Swiss Patent Application No. 01258/07, filed Aug. 8, 2007, the entire contents of all of which are incorporated by reference as if fully set forth.

FIELD OF INVENTION

The present invention refers to a method for improving the sealing between a rotor and a plurality of blades which are anchored in the rotor and arranged in the form of an encompassing ring, according to the preamble of claim 1. Furthermore, the present invention also refers to the correspondingly formed rotors or blades.

BACKGROUND

As known for a long time and evident for example from U.S. Pat. No. 6,030,178 or equally from US 2004/165989, especially in the case of rotors for turbines, the individual blades are fastened on a rotor in a ring by the rotor having a multiplicity of recesses on its outer circumference which are arranged axially and parallel next to each other in the circumferential direction and which for example are formed as female configurations of a fir-tree profile. The blades which are to be installed have a blade root which corresponds in shape and is formed as corresponding male configurations of the fir-tree profile in relation to the corresponding female configurations in the rotor. When installing the rotor, the blades are inserted in succession in the axial direction into these recesses of the rotor, and for sealing between the adjacent blades the lower shrouds of the adjacent blades are pushed next to each other in the process. As has been known from WO 03/027445, in this case the fact is to be taken into account that on the hand there must always be the best possible seal between the adjacent shrouds, but that on the other hand the heat-induced expansion of the individual components also has to be taken into consideration.

SUMMARY

The disclosure is directed to a method for improving sealing between a rotor and a plurality of blades which are anchored in the rotor and arranged in the form of an encompassing ring. The rotor has a plurality of generally axially extending recesses into which a ring of blades, which have corresponding blade root profiles which correspond to the recesses, are inserted in a form-fitting and/or frictionally locking manner in a generally axial insertion direction. Between the recesses the rotor has tangential surface sections or circumferential surface sections which extend in the axial direction and circumferential direction and are generally at least indirectly covered by lower shrouds of circumferentially adjacently arranged blades in the radial direction. The method includes providing at least one of the tangential surface sections or circumferential surface sections with a stop element in the radial direction. The method also includes providing a corresponding recess in an underside of the shroud of the blade which is arranged above it.

In another embodiment, the disclosure is directed to a blade including a blade root and a blade airfoil formed thereupon. The blade root has a blade root profile and a lower shroud, and on an underside of the shroud there is a recess which is open in an insertion direction towards a rotor. The recess preferably extends over an entire tangential or circumferential width of the underside of the shroud on two sides of the blade airfoil.

In a further embodiment, the disclosure is directed to a rotor for anchoring an encompassing ring of blades. The rotor includes a plurality of generally axially extending profiled recesses into which the ring of blades, which have corresponding blade root profiles, can be inserted in a form-fitting and/or frictionally locking manner into these recesses in a generally axial insertion direction. Between the recesses the rotor has tangential surface sections or circumferential surface sections which extend in the axial direction and circumferential direction and are generally at least indirectly covered by lower shrouds of circumferentially adjacently arranged blades in the radial direction, at least one of the tangential surface sections or circumferential surface sections is provided with a stop element in the radial direction.

BRIEF DESCRIPTION OF THE DRAWINGS

The invention shall subsequently be explained in more detail based on exemplary embodiments in conjunction with the drawings. In the drawing.

DETAILED DESCRIPTION OF THE PREFERRED EMBODIMENTS

Introduction to the Embodiments

Figure 1:
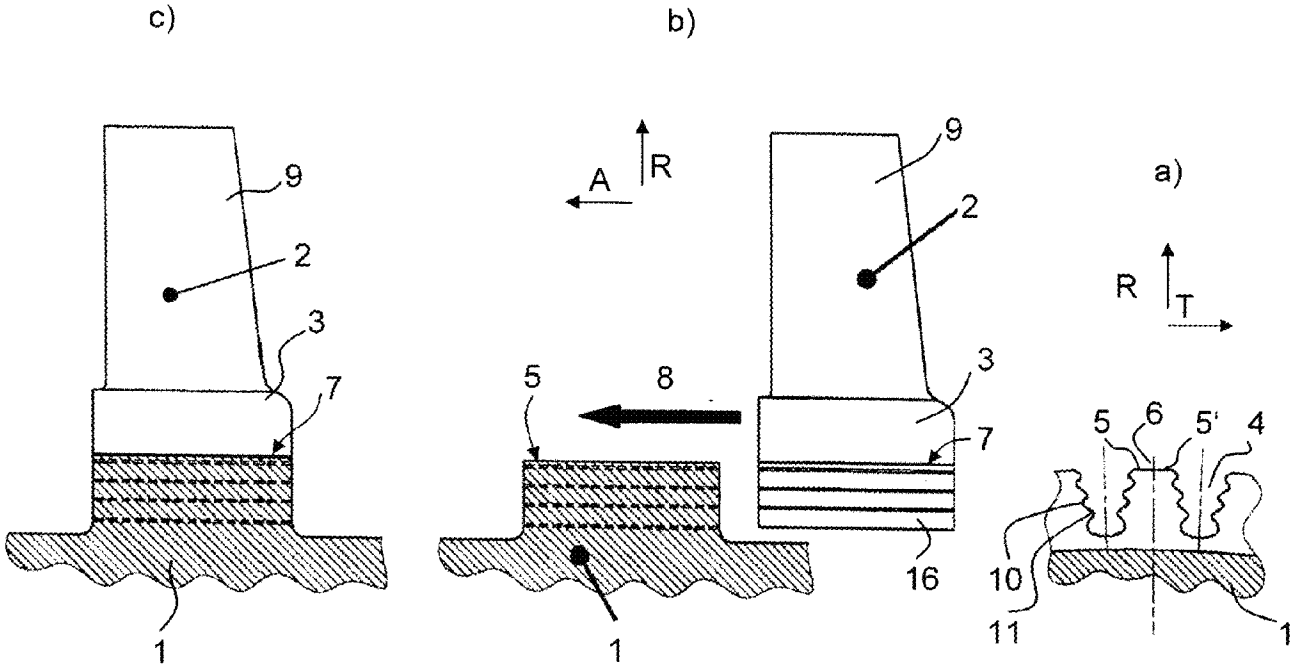
Fig. 1 (Prior Art)
FIGS. 1*a*-1*c* show different views of a rotor with the corresponding installation of a blade according to the prior art, wherein in a) a section vertically to the axis of the rotor is shown, in b) an axial section shortly before inserting the blade, and in c) the fully inserted blade in the rotor.

The disclosure is consequently based inter alia upon the object of providing a simple method for improving the sealing on constructions of rotors of the type referred to in the introduction. In particular, it is a matter therefore of proposing a thus improved method for a rotor with a plurality of blades which are anchored in the rotor and arranged in the form of an encompassing ring. In this case, the rotor has a plurality of essentially axially extending profiled recesses, which are provided with a profile, into which a ring of blades, which have blade root profiles which correspond to the profile, are inserted preferably in a form-fitting and/or frictionally locking manner in an essentially axial insertion direction. Moreover, between the recesses the rotor has tangential surface sections or circumferential surface sections which extend in the axial direction and circumferential direction and are essentially at least indirectly covered by lower shrouds of circumferentially adjacently arranged blades in the radial direction.

The achieving of this object is achieved by at least one of the tangential surface sections or circumferential surface sections being provided with a step in the radial direction, and by a corresponding recess being provided in the underside of the shroud of the blade which is located above it.

The basis of the invention is therefore to ensure an improvement of the sealing between rotor and blade or shroud of the blade, virtually in the sense of a labyrinth seal. As an additional effect, with a clever arrangement of the steps, it happens in this case that the blade is pushed onto a stop during the insertion. In other words, as a result of the step the correct axial position for the fixing is determined.

This stop, as is known from the prior art for example in U.S. Pat. No. 5,067,877 and from many other documents from the field of such rotors, is not provided over an encompassing construction (stop ring), but is provided only over the proposed steps which are arranged only in the region of the circumferential surface sections in each case, which at the same time allows the necessary sealing action or precisely directed flow of cooling air.

In a first preferred embodiment of the method, the steps are provided on all the circumferential surface sections of the rotor which are arranged around a circumference, and corresponding recesses are provided on all the blades. Thus, it possible for example to consequently produce the steps on the rotor, which extend outwards in the radial direction, by the circumferential surface sections first being produced with an outer radius which corresponds to the outer radius of the flat steps, and then by being milled down to the desired depth in the region in which the steps are not located. The corresponding recesses can correspondingly be machined out on the underside of the shrouds of the blades.

Particularly with regard to the aforementioned additional effect, as a stop for axial fixing of the blades it proves to be advantageous if the steps are arranged on a stop side of the rotor which is opposite the insertion side and are preferably flush with this stop side. The steps are preferably formed as ring sections on the circumferential surface sections with a cross section which is rectangular or square in axial section (other shapes such as a triangle, trapezium or corresponding rounded shapes are also possible, however). There is preferably a radial section (virtually a stop face), the surface normal of which points in the axial direction, and an axial section, the surface normal of which points in the radial direction. The steps are advantageously formed over less than 50% of the axial extent of the circumferential surface sections, preferably over less than 20%, especially preferably over less than 10% of the axial extent of the circumferential surface sections.

According to a preferred embodiment of the method, the steps are formed with a radial height which serves for the final purpose in each case and is in dependence upon the respectively designed steps. As previously explained in the introduction, the steps and the recesses are advantageously designed in a flush manner (in the axial direction and in the radial direction), wherein if necessary seals may be additionally arranged in the edge region or over the entire step, or profiling is carried out which indeed fulfills the one purpose but in addition also observes the specially sought-after sealing tightness.

Furthermore, the present disclosure refers to a blade, especially for use in a method as was described above. The blade is preferably has a blade airfoil and a blade root which is formed thereupon, wherein the blade root has a blade root profile and a lower shroud, and on the underside of the shroud there is a recess which is open in the insertion direction and towards the rotor, wherein the recess preferably extends over the entire tangential or circumferential width of the underside of the shroud on the two sides of the blade airfoil. The blade root profile is typically formed as a dovetail profile or as a fir-tree profile. Moreover, it is possible for such a blade to additionally have an upper shroud, 17 as shown in FIGS. 2*b*, 2*c*.

Moreover, the present disclosure refers to a rotor, especially for use in one of the methods as was described above, and preferably for the common use with the blade as was described above. The rotor is preferably formed for anchoring an encompassing ring of blades, for which the rotor has a plurality of essentially axially extending profiled recesses into which the ring of blades, which have corresponding blade root profiles, can be inserted in a preferably form-fitting and/or frictionally locking manner into these recesses in an essentially axial insertion direction, and wherein between the recesses the rotor has tangential surface sections or circumferential surface sections which extend in the axial direction and circumferential direction and are essentially at least indirectly covered by lower shrouds of circumferentially adjacently arranged blades in the radial direction. In this case, at least one of the tangential surface sections or circumferential surface sections is provided with a step in the radial direction. The profiled recesses are preferably formed in this case as dovetail profiles or fir-tree profiles.

Further preferred embodiments are described in the dependent claims.

DETAILED DESCRIPTION

In the following, with the aid of exemplary embodiments, the invention, as was described in the introduction and is defined in the appended claims, shall be explained further. The discussion of the exemplary embodiments which now follows is not to be consulted in this case, however, for limitation of the general inventive idea as is worded in the claims.

In FIG. 1, a construction of a rotor according to the prior art is first shown.

As apparent from FIG. 1*a*), from a section through a rotor, without inserted blades, vertically to the axis of the rotor, the rotor 1 comprises a central section which has a circumferential surface essentially in the form of a cylinder surface. In this circumferential surface, recesses 4 which extend in the axial direction A are formed. In this case, the recesses are formed as fir-tree profiles. The recesses 4 extend in the radial direction R inwards towards the axis of the rotor. The fir-tree profiles have grooves 10 and ribs 11 which are arranged in each case in an alternating manner and arranged in the axial direction. The recesses 4 serve for the axially inserting seating of the blades 2 which are formed with a corresponding male profile on the blade root.

The recesses 4 are uniformly distributed around the circumference of the rotor 1, and sections of the essentially cylindrical circumferential surface remain between the individual recesses 4. If the blades 2 are inserted, these circumferential surface sections 5 as a rule are covered by the blade root 3, and specifically by the lower shroud 7 of the blade 2.

Between adjacent blades 2 there is correspondingly an axial symmetry plane 6, and between two adjacent recesses 4 the circumferential surface is thus split into two circumferential surface sections 5 and 5' in each case. The sections 5, 5' can actually be formed as curved sections of a cylinder surface, but they can also be formed as tangential planes, wherein 5 or 5' can be arranged in the same plane or can be inclined towards each other.

In FIG. 1*b*), the process of inserting a blade is schematically shown. This is in a section in the plane of the axis of the rotor, that is to say in a radial direction.

A blade 2 comprises a blade airfoil 9 which if necessary can additionally have a shroud on the radially outer side (not shown in this Figure). The blade root 3, which is formed on the underside, on one side comprises a lower shroud 7 and the blade root profile 16 which is formed on this on the bottom in the radial direction.

The blade root profile 16 virtually corresponds to a negative of the recesses 4, that is to say it is also formed as a corresponding fir-tree profile. The fir-tree profile of the blade root profile 16 in this case corresponds as accurately as possible to the fir-tree profile of the recesses 4 in order to ensure a snug seating of 16 in 4. If necessary, it is possible to ensure an automatic wedging of the blade 2 in the recesses 4 during insertion by a tapering of the recesses 4 which is formed in the insertion direction 8. Alternatively or additionally, it is possible to provide the blade root profile 16 with a corresponding tapering providing one of these measures in a special case proves to be a preferred variant.

As apparent from FIG. 1*b*), the blade is inserted in an axial direction A into the recesses 4 in the insertion direction 8, wherein the lower shroud as a rule rests essentially in a flush manner against the circumferential surface sections 5.

In FIG. 1*c*), the blade in the inserted state is shown, and it can be seen here that between the lower shroud 7 and the rotor 1 an abutment edge, which extends in the axial direction, is formed, which is correspondingly possibly also accessible to an airflow.

Figure 2:
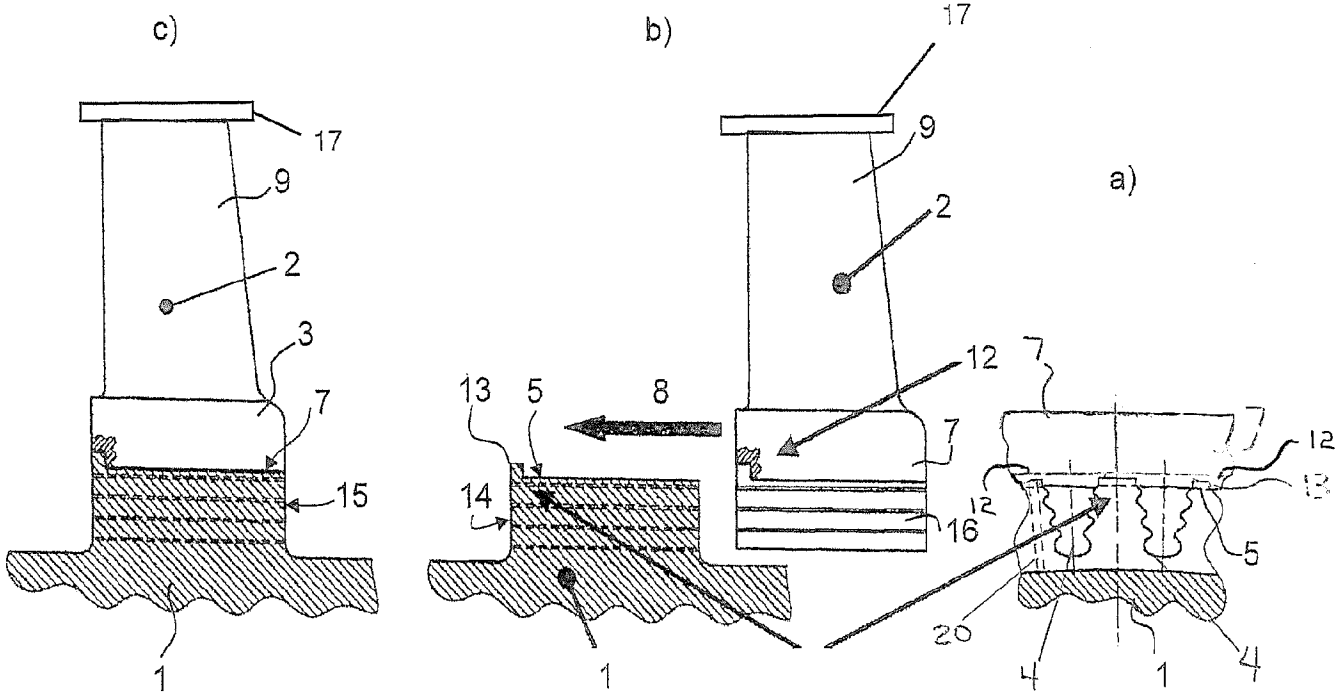
FIGS. 2*a*-2*c* show corresponding views of a rotor or of a blade according to the present invention in corresponding views.

In FIG. 2, a modification according to the disclosure of such a blade 2 is now shown. In FIG. 2, corresponding views to FIG. 1 are shown, that is to say in a) a section vertical to the axis of the rotor, in b) a view during insertion of a blade, and in c) a virtual side view of an inserted blade.

As apparent from FIG. 2*a*) and *b*), a projection 13 is arranged on the front end of the rotor 1 in the insertion direction 8 (on the stop side 14), which can be referred to as a stop element 13. In this case, this stop element 13 extends in the circumferential direction in each case between two adjacent recesses 4 over the entire tangential extent of the circumferential surface sections 5 or 5'.

It is alternatively also possible, however, for example to provide such a stop element 13 only in the region 5 or only in the region 5' in each case.

The possibility which is shown in FIG. 2, however, can be especially simply realized as regards production engineering since the rotor 1 in this case can be simply formed with a slightly larger circumferential radius for the circumferential surface 5, and in the regions which are located behind the stop element 13 in the insertion direction 8 can be milled or dressed around the entire circumference (metallically stripped feature).

Alternatively, it is also possible, however, to mount the stop elements 13 to a certain extent as ring sections onto the circumferential surface sections 5, for example by screwing, welding or soldering (metallically built-up feature).

The stop element 13 typically has a rectangular shape in axial section which is apparent from FIG. 2*b*). It is also possible, however, to form the stop element 13 as a trapezium or to a certain extent as a triangle, wherein the inclined flanks can face the blade 2, and consequently further wedging results with the blade pushed on.

The blade 2 in turn, on the underside of the shroud 7, has a recess 12 which corresponds to the stop element 13. The recess 12 is arranged on the front end of the blade 2 in the insertion direction 8. The recess 12 has the corresponding female profile to the so-to-speak male stop element 13.

As apparent from FIG. 2*c*), the stop element 13 defines the end position of the blade since the blade is inserted until the recess 12 has fully accommodated the stop element 13 inside it and comes up against its surface which faces the axial direction. Apart from the sealing effect, the design according to the disclosure therefore leads to the correct axial positioning of the blade.

As a result of the angled run of the edge between the shroud 7 and the rotor 1 which consequently exists, a labyrinth seal to a certain extent results between rotor and blade. The sealing effect between rotor and blade can be additionally increased by sealing material being introduced between these two elements.

The stepped shape can also be used in a precisely directed manner just for allowing a desired amount of air to flow through the gap for example for cooling. Thus, it is possible, for example, to allow cooling air passages 20 to lead outwards from the sections 5 in the radial direction and to then feed the cooling air which is blown out there along the stepped run between stop element 13 and recess 12.

With a diameter of a conventional rotor and an axial length of the surfaces in the region of 30-400 mm, the stop element 13 is preferably formed with a width in the axial direction A in the region of 3-20 mm, and with a height in the radial direction R in the region of 1-20 mm.

Figure 3:
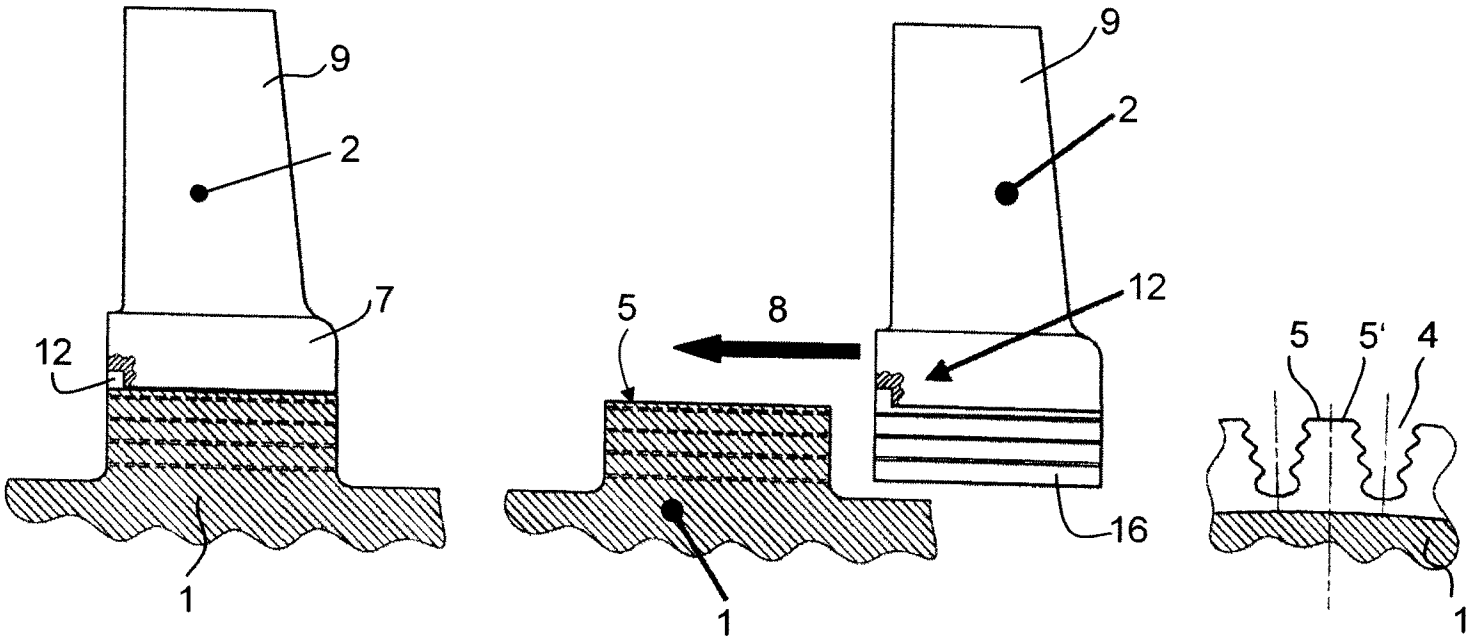
FIG. 3 shows corresponding views of a rotor according to the prior art with a blade according to the present invention in corresponding views.

As apparent from FIG. 3, moreover, in the case of the proposed development, the advantage is created of a blade which is designed according to the disclosure also being able to be pushed onto an existing rotor 1, that is to say onto a rotor without stop element 13. Thus, the presence of the recess 12 does not interfere with the compatibility of new blades with existing rotors. New rotor blades can easily be installed on existing rotors (blade retrofit). The flexibility which is achievable and available as a result allows an enormous degree of freedom in the case of retrofit applications.

LIST OF DESIGNATIONS

1 Rotor
2 Blade
3 Blade root
4 Axial recess with fir-tree profile
5 Circumferential surface sections of 1
6 Axial symmetry line between adjacent blades
7 Encompassing cover region of 2, lower shroud
8 Insertion direction
9 Blade airfoil
10 Groove of 4
11 Rib of 4
12 Recess on underside of 7
13 Stop element
14 Stop side of 1
15 Insertion side of 1
16 Blade root profile
17 Upper shroud
A Axial direction
R Radial direction
T Tangential direction

What is claimed is:

1. A method for improving sealing between a rotor and a plurality of blades which are anchored in the rotor and arranged in the form of an encompassing ring, wherein the rotor has a plurality of generally axially extending first recesses into which a ring of blades, which have corresponding blade root profiles which correspond to the first recesses, are inserted in a form-fitting and/or frictionally locking manner in a generally axial insertion direction, and wherein between the first recesses the rotor has circumferential surface sections which extend in the axial direction and circumferential direction and are generally at least indirectly covered by lower shrouds of circumferentially adjacently arranged blades in a radial direction, the method comprising:

providing the circumferential surface sections with stop elements in the radial direction, wherein the stop elements have a rectangular or square cross section in axial section, providing a second recess in an underside of the shroud of each of the plurality of blades, wherein second recesses of first and second adjacent blades of the plurality of blades abut the stop elements along an entire circumferential length of the stop element, and the stop elements are fully accommodated in the second recesses, wherein the stop elements and the corresponding second recesses are configured in a stepped shape forming a labyrinth seal, wherein the labyrinth seal is configured to allow an amount of cooling air to flow to the stepped shape, and providing cooling air passages in the rotor and leading outwards from the surface sections in the radial direction for feeding the cooling air which is blown out along the stepped shape between the stop elements and the second recesses, wherein the stop elements comprise ring sections connected to the circumferential surface sections by welding or soldering.

2. The method as claimed in claim 1, wherein the stop elements are arranged on a stop side which is opposite the insertion side.

3. The method as claimed in claim 1, wherein the stop elements are formed over less than 10% of the axial extent of the circumferential surface sections.

4. The method as claimed in claim 1, wherein the stop elements have a radial height in the region of 4 mm.

5. An arrangement for fastening a plurality of blades on a rotor, comprising:

the rotor including a plurality of generally axially extending profiled first recesses into which a ring of blades, which have corresponding blade root profiles, can be inserted in a form-fitting and/or frictionally locking manner into these first recesses in a generally axial insertion direction, wherein between the first recesses the rotor has circumferential surface sections which extend in the axial direction and circumferential direction and are covered by lower shrouds of circumferentially adjacently arranged blades in a radial direction;

a plurality of blades, each blade including a blade root and a blade airfoil which is formed thereupon, wherein the blade root has a blade root profile and a lower shroud, and on an underside of the shroud there is a second recess which is open in an insertion direction towards the rotor;

the circumferential surface sections are provided with stop elements in the radial direction wherein the stop elements have a rectangular or square cross section in axial section, the second recesses of adjacent first and second blades of the plurality of blades abut the stop elements along an entire circumferential length of the stop elements and the stop elements are fully accommodated in the second recesses, wherein the stop elements and the corresponding second recesses are configured in a stepped shape forming a labyrinth seal, wherein the labyrinth seal is configured to allow an amount of cooling air to flow to the stepped shape, wherein cooling air passages lead outwards from the surface sections in the radial direction for feeding cooling air which is blown out along the stepped shape between the stop elements and the second recesses, wherein the stop elements comprise ring sections connected to the circumferential surface sections by welding or soldering.

6. The arrangement of claim 5, wherein the blade root profile is formed as a dovetail profile or as a fir-tree profile.

7. The arrangement of claim 5, wherein each blade further comprises an upper shroud.

8. The arrangement of claim 5, wherein the profiled first recesses are formed as dovetail profiles or fir-tree profiles.

9. The arrangement of claim 5, wherein the rotor is circumferentially configured so that an equal or different number of blades per stage is installed.

10. The arrangement of claim 5, wherein the rotor and/or the blades are axially fixable in a front or rear region.

* * * * *